US007028343B1

(12) United States Patent
Watson

(10) Patent No.: US 7,028,343 B1
(45) Date of Patent: Apr. 18, 2006

(54) EAR COVER AND METHOD

(76) Inventor: Deborah Watson, 1906 Hiland St., Saginaw, MI (US) 48601

( * ) Notice: Subject to any disclaimer, the term of this patent is extended or adjusted under 35 U.S.C. 154(b) by 199 days.

(21) Appl. No.: 10/606,383

(22) Filed: Jun. 27, 2003

(51) Int. Cl.
*A42B 1/06* (2006.01)

(52) U.S. Cl. ..... 2/209; 2/174; 2/455

(58) Field of Classification Search ..... 2/174, 2/209, 455; 128/864, 866
See application file for complete search history.

(56) References Cited

U.S. PATENT DOCUMENTS

| | | | | |
|---|---|---|---|---|
| 3,525,103 | A * | 8/1970 | Yonan | 2/174 |
| 3,823,713 | A | 7/1974 | Shah | |
| 4,134,153 | A | 1/1979 | Voorhees | |
| 4,308,623 | A | 1/1982 | Voorhees | |
| 4,616,643 | A | 10/1986 | Jung | |
| 4,660,229 | A | 4/1987 | Harris | |
| 5,615,417 | A * | 4/1997 | Jackson | 2/209 |
| 5,689,831 | A * | 11/1997 | Harris | 2/209 |
| 5,718,001 | A | 2/1998 | Wright | |
| 5,749,099 | A | 5/1998 | Voorhees | |
| 6,195,806 | B1 | 3/2001 | Campbell | |
| 6,237,157 | B1 | 5/2001 | Lobbins | |
| 6,298,493 | B1 | 10/2001 | Ambroise | |
| 2001/0029622 | A1 | 10/2001 | Bose et al. | |

FOREIGN PATENT DOCUMENTS

| | | |
|---|---|---|
| EP | 0 047 270 B1 | 3/1984 |

* cited by examiner

*Primary Examiner*—Katherine Moran
*Assistant Examiner*—Richale L. Haney
(74) *Attorney, Agent, or Firm*—John J. Swartz

(57) ABSTRACT

An ear protector and ear cover for and method covering, protecting and holding the folded ear on a person's head while the hair of the person is being treated. The cover includes a flexible, water impervious strip shield for covering and holding the ear in a forwardly folded condition. The flexible strip shield includes one side with a central non-adhesive ear engaging portion for bearing against the folded ear and an adhesive border strip surrounding the central portion for adhesively sealing to the portion of the person's head surrounding the ear.

13 Claims, 3 Drawing Sheets

EAR COVER AND METHOD

BACKGROUND OF THE INVENTION

1. Field of the Invention

This invention relates to an ear cover for covering and protecting the ear from fluids and hot implements utilized to treat the hair on a person's head.

2. Description of Prior Art and Objects

When a person's hair is being shampooed, colored or treated with various other fluid chemicals, it is common for such fluids to inadvertently enter the inner ear of a person being treated. In addition to being generally annoying, individuals suffering from sores, cuts, or other ear problems, can have their condition exacerbated by the entry of such fluids into the ear. Accordingly, it is an object of the present invention to provide a new and novel ear cover for covering the ear to preclude the entry of fluids being used to treat a person's hair.

Beauticians frequently utilize hot implements such as a curling iron for processing the hair and occasionally such irons will touch the protruding external ear structure causing extreme pain. Accordingly, it is another object of the present invention to provide a new and novel ear cover which will protect the external ear structure from being burned by an implement used to treat a person's hair.

Various ear covers have been provided heretofore but are complicated and are relatively expensive to manufacture such as that illustrated in U.S. Pat. No. 4,134,153 issued to Donna S. Voorhees on Jan. 16, 1979; U.S. Pat. No. 4,308,623 issued to Donna S. Voorhees on Jan. 5, 1982; U.S. Pat. No. 4,616,643 issued to Ha Y. Jung on Oct. 14, 1986; U.S. Pat. No. 4,660,229 issued to Paul W. Harris on Apr. 28, 1987; U.S. Pat. No. 5,718,001 issued to Jacquelin E. Wright on Feb. 17, 1998; U.S. Pat. No. 5,749,099 issued to Donna Sue Voorhees on May 12, 1998; U.S. Pat. No. 6,195,806 B1 issued to Staphea S. Campbell on Mar. 6, 2001; U.S. Pat. No. 6,237,157 B1 issued to Claudette Yvonne Lobbins on May 29, 2001; U.S. Pat. No. 6,298,493 B1 issued to Bernice Ambroise on Oct. 9, 2001; as well as U.S. Patent Publication 2001/0029622 A1 of Jeaneth Bose published on Apr. 18, 2001. The structures in the aforementioned patents generally provide bags or caps which receive the ear in its normal condition and are expensive to manufacture. Accordingly, it is an object of the present invention to provide a new and novel ear cover which is relatively inexpensive to manufacture.

It is another object of the present invention to provide an ear cover formed from a sheet of thin flexible material which can cover the ear and be secured to the portion of the skull or skin surrounding the user's head without enveloping the ear in a bag or cap.

U.S. Pat. No. 5,689,831 issued to Yvette L. Harris on Nov. 25, 1997, discloses an ear protector formed from a sheet of thin flexible material which has a curved flap that fits over the helix of the pinna of the exterior ear. This construction is complicated and expensive to manufacture and does not provide a waterproof seal to preclude water from entering the ear.

Accordingly, it is another object of the present invention to provide a new and novel ear cover which will adhesively seal to the skull skin surrounding the user's ear to insure that any hair treating liquid does not enter the inner ear canal.

It has been found according to the present invention that forwardly folding the ear prior to covering the ear will greatly assist in protecting or shielding the inner ear from the admission of fluids and from being engaged by hair treating utensils. Accordingly, it is another object of the present invention to provide a new and novel ear protector and method which will hold the ear in a forwardly folded position while hair is being treated.

Still another object of the present invention is to provide a flexible sheet which will cover and hold the forwardly folded ear and includes a perimetrical adhesive border for sealing to the portion of the person's head surrounding the folded ear.

Yet another object of the present invention is to provide an ear cover of the type described which includes a central non-adhesive area for bearing against the folded ear and a ring of adhesive material surrounding the non-adhesive area for adhesively sealing to the portion of the head surrounding the ear.

It is a still further another object of the present invention to provide an apparatus and method of covering and protecting the ear including forwardly folding the ear and holding it in a forwardly folded condition.

Some individuals have conditions which prohibit any burning of the outer ear. Accordingly, it is an object of the present invention to provide a new and novel ear cover which includes a laminate having a sheet of heat resistant material and a sheet of water impervious material having a perimetrical border for sealingly engaging the user's head.

It is a further object of the present invention to provide an ear cover of the type described which includes a central pad of non-adhesive material, for bearing against the folded ear, mounted on a water impervious flexible strip that surrounds the central pad and adhesively seals to the portion of the head surrounding the ear and holds the padded area against the folded ear while the hair is being treated.

It has been found according to the present invention that it may be advantageous to increase the width of the cover along the lower edge thereof relative to the upper edge so that increased adhesive can be provided to secure the device to the skin on the user's head below the ear. Accordingly, it is another object of the present invention to provide a new and novel ear cover which is narrower at the top than at the bottom.

It is yet another object of the present invention to provide a new and novel ear cover of the type described which has a bell shape.

It is a further object of the present invention to provide an ear cover of the type described which includes a rectangular central pad mounted on a flexible water impervious sheet having a bell shape with a perimetrical border provided with adhesive on one side thereof for adhesively sealing to the skin of the user's head surrounding the ear.

These and other objects of the present invention will become more readily apparent as the descriptions hereof proceeds:

SUMMARY OF THE INVENTION

An ear cover for covering, protecting and holding a folded ear of a person's head in a forwardly folded condition while the hair on the person's head is being treated, comprising an ear engaging sheet of thin flexible non-adhesive material for bearing against the folded ear and a mounting sheet of thin flexible material mounting the ear engaging sheet and having an adhesive border coupled to but projecting outwardly from the border of the ear engaging sheet for adhesively sealing to the portion of the person's head adjacent the folded ear.

DESCRIPTION OF THE DRAWINGS

The invention may be more readily understood by referring to the accompanying drawings, in which.

DESCRIPTION OF PREFERRED EMBODIMENT

Figure 1:
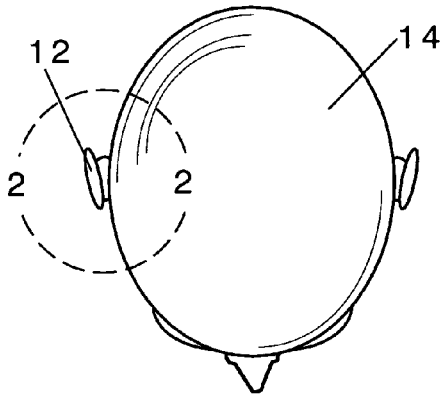
FIG. 1 is a top plan view of a person's head schematically illustrating the external ears in a normal unfolded condition.
Figure 2:
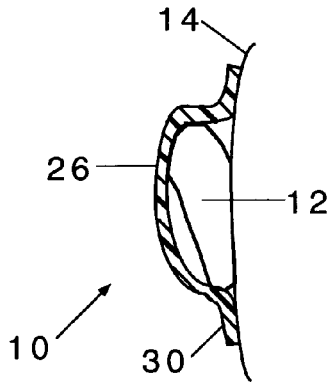
FIG. 2 is an enlarged top plan sectional view, of the portion illustrated in the chain line circle 2—2 of FIG. 1, illustrating an ear cover, constructed according to the present invention, holding one of the ears to the person's head in a forwardly folded condition.
Figure 3:
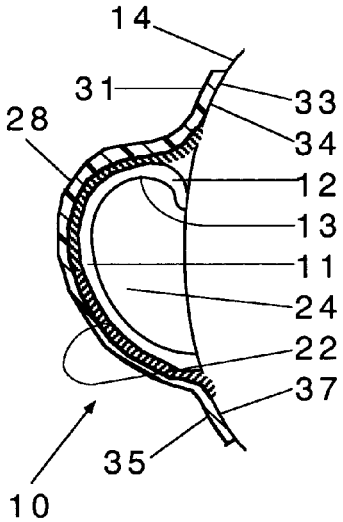
FIG. 3 is a slightly further enlarged top plan sectional view similar to FIG. 2.
Figure 4:
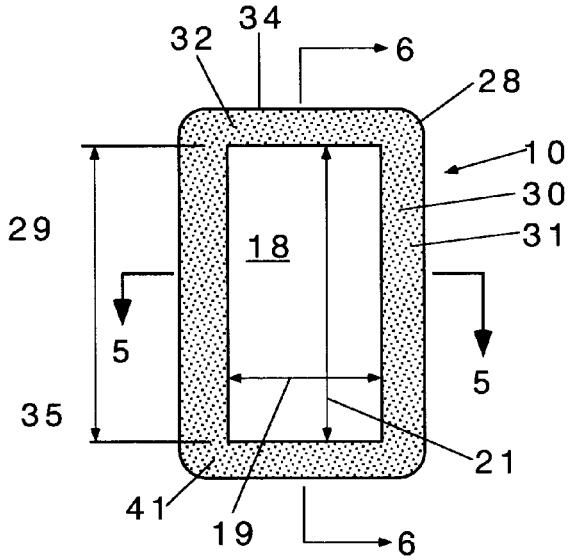
FIG. 4 is a side elevational view of the ear cover.
Figure 5:
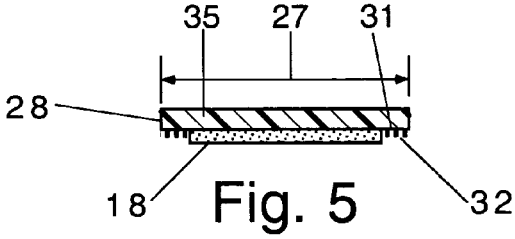
FIG. 5 is a top plan sectional end view thereof, taken along the section line 5—5 of FIG. 4.

Apparatus constructed according to the present invention, generally designated 10 and illustrated in FIGS. 1–6, is particularly adapted for use in covering the external ear, generally designated 12, on a person's head 14. The external or outer ear as used in this specification is deemed to comprise in general the outer ear or helix 11 of the pinna 13, the anti-helix, the fossa of the anti-helix, the antitragus, the tragus and lobe. Prior to treating the person's hair, the outer ear or helix 11 is manually forwardly folded on itself to provide a fold 24 (FIG. 3).

The cover 10 includes a flexible strip or pad 18 of gauze or other soft material for bearing against the outer ear surface 22 of the fold 24 in the folded position illustrated in FIG. 3. The outer surface 17 of pad 18 is mounted on the inner surface 25 of the central portion 26 of a flexible fluid impervious strip, generally designated 28, having a perimetrical border or ring 30 which surrounds the perimetrical border 19 of pad 18. The inner surface of the border 30 is provided with a layer 32 of pressure sensitive adhesive for bearing against the portion 34 of the skull 14 surrounding the user's ear 12. The perimetrical border ring 30 includes a rear adhesive portion 31 for engaging the portion 33 of the skull rearwardly of the ear 12 and a forward portion 35 for engaging the portion 37 of the skull skin forward of the ear 12. The adhesive border 30 also includes upper and lower adhesive portions 39 and 41, respectively, for engaging the skin of the person's surrounding the ear above and below, respectively, the ear 12.

The gauze pad 18 formed of a flexible material which permits air to flow therethrough. The material can comprise an open cell material such as reticulated polyurethane foam produced by the foam division of Scott Paper Company, 1500 East Second Street, Chester, Pa. The flexible strip shield 28 may suitably comprise the strips of water impervious hypo-allergenic strips sold by Johnson & Johnson Consumer Companies, Inc., Skillman, N.J., 08558-9418, under the trademarks "COMPEED and "MOISTURE SEAL". The strips or sheets 18 and 28 thus form a laminate which is flexible, waterproof, thin and discrete and provides a new and improved cover which holds the ear in the folded condition and provides a water impervious seal that is heat resistant and protects the ear being touched by a hot curling iron.

The gauze pad 18 has a width 19 and a height 21 whereas the water impervious strip 18 has a width 27 and a height 29 which is substantially greater than the width 19 and height 21, respectively, of the pad 18.

Figure 6:
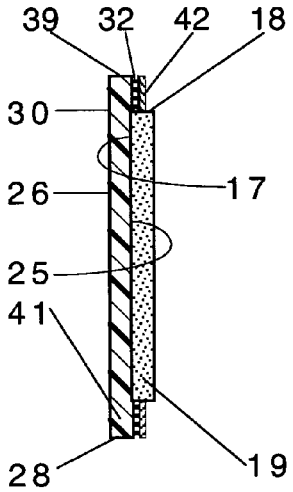
FIG. 6 is a front end sectional view, taken along the section line 6—6 of FIG. 4, but illustrates a detachable cover for covering the border adhesive prior to use.
Figure 7:
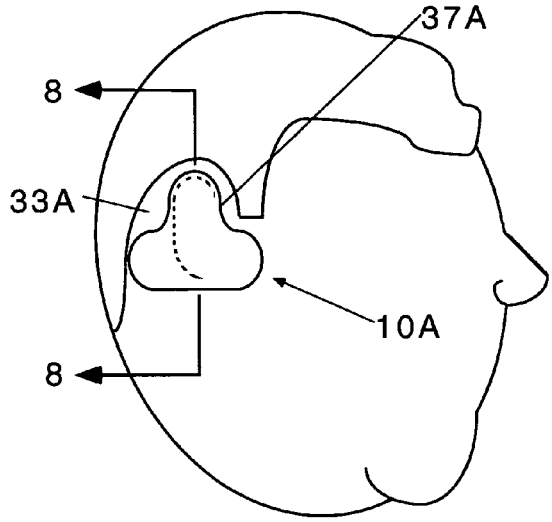
FIG. 7 is a side elevational view illustrating a slightly modified ear cover embodiment mounted on a person's head.
Figure 8:
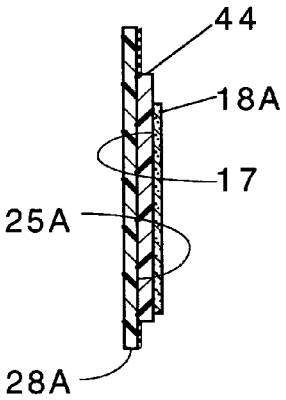
FIG. 8 is a front sectional end view thereof, taken along the section line 8—8 of FIG. 7.

A detachable protective cover 42 illustrated in FIG. 6 initially covers the adhesive layer 32 and is easily detachable therefrom to expose the adhesive layer 32 when it is desired to attach the cover 10 to the person's head.

METHOD AND OPERATION

Before a person's head is treated with shampoo dye, curling irons, etc., the cover 10 is applied to each of the ears 12.

The helix 11 of the pinna 13 is folded forwardly from the position illustrated in FIG. 1 to the folded position illustrated in FIGS. 2 and 3. The protective cover 42 is removed from the border 30 and the rear adhesive portion 31 is applied to the portion 33 of the head 32 rearward of the ear 12. The mid-portion 26 of flexible strip 28 is formed or shaped over the ear fold 22 while concurrently pressing the upper and lower adhesive portions 39 and 41 against the upper and lower portions of the skull surrounding the ear 12. The forward adhesive edge 35 is then adhesively sealed to the front portion 37 of the head to provide a waterproof adhesive seal completely surrounding the folded ear to preclude hair treating fluid from entering the ear 12 and will hold the ear in the folded condition illustrated in FIG. 3. The cover 10 also protects the ear from being inadvertently touched by a hot curling iron.

ALTERNATE EMBODIMENT

Referring now more particularly to FIGS. 7–10 a slightly modified embodiment, generally designated 10A, is illustrated and is similar in many respects to the cover 10. Similar parts will be identified by similar reference characters followed by the letter A.

Figure 9:
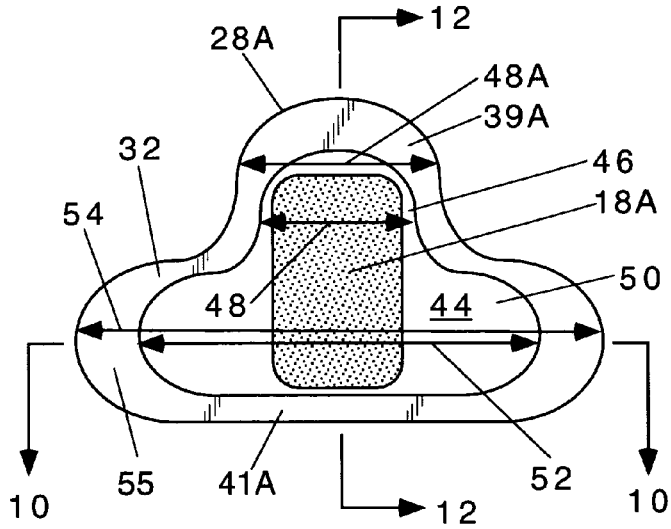
FIG. 9 is an enlarged opposite side elevational view of the ear cover illustrated in FIG. 7.

The cover 10A differs from the cover 10 in that a laminate is formed by sandwiching an additional flexible strip or sheet 44 of heat resistant material between the outer surface 17A of pad 18A and the inner surface 25A of the water impervious strip 28A. The heat resistant material 44 has a bell shape, as illustrated in FIG. 9, provided with an upper portion 46 having a width 48 and a lower portion 50 having a substantially greater width 52. The upper water impervious sheet 28A also has a bell shape and includes an upper portion 39A which has a width 48A that is greater than the width 48 and a lower enlarged portion, generally designated 55, having a width 54 which is substantially greater than the widths 48, 48A and 52. The sheet 28A also includes as well as a lower portion 41A along the underside of the gauze pad 18A. The lower heat strip portion 55 and lower strip portion 41A will typically engage the side of the head below the hairline H.

The heat resistant material for sheet 44 may suitably comprise a fiber content cover including 100% cotton with Teflon® and titanium coating such as that sold by Home Products International Inc., 4501 West 47$^{th}$ Street, Chicago, Ill. 60632, under the trademark Scorchshield which is heat, chemical and water resistant.

SECOND ALTERNATIVE EMBODIMENT

Figure 10:
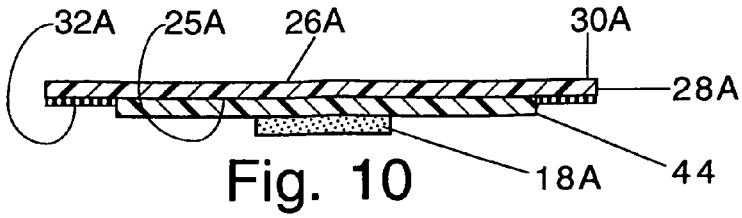
FIG. 10 is a top plan sectional view taken along the line 10—10 of FIG. 9.
Figure 11:
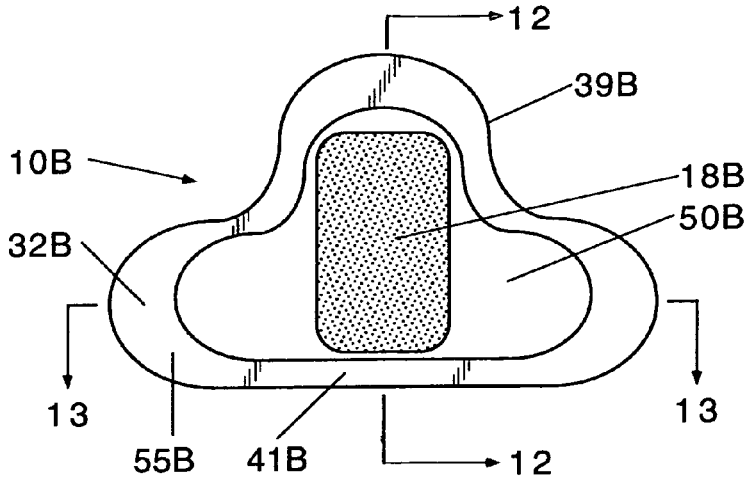
FIG. 11 is a side elevational view, similar to FIG. 9, illustrating another slightly modified embodiment.
Figure 12:
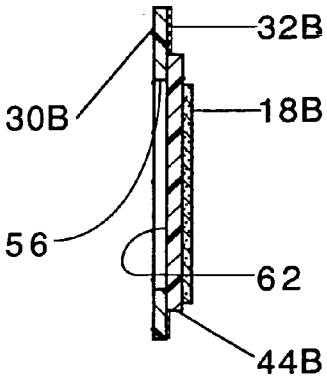
FIG. 12 is a front sectional end view, taken along the line 12—12 of FIG. 9.
Figure 13:
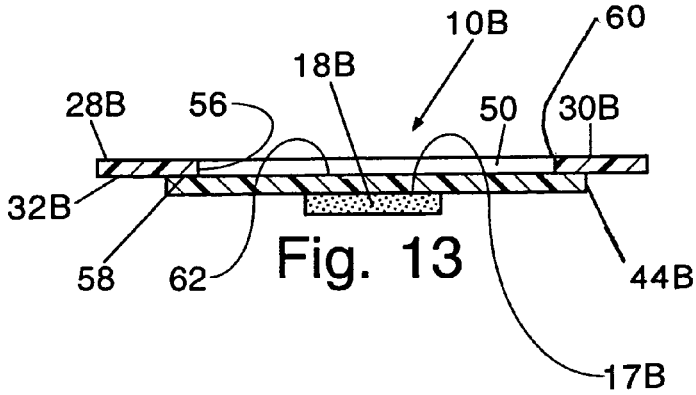
FIG. 13 is a top plan sectional view, taken along the section line 13—13 of FIG. 10.

Referring now more particularly to FIGS. 11–13, a further slightly modified cover, generally designated 10B, is illustrated and is generally similar to the cover 10A illustrated in FIGS. 7–10 and generally similarly parts will be referred to with generally similar reference character followed by the letter B.

The cover 10B is similar to the embodiment illustrated in FIGS. 9–11 except that the water impervious strip 28B has a central bell shaped opening 56, generally aligned with the heat resistant cover 44B. The inner edge portion 60 of the inner surface 17B of water impervious strip 28B overlaps the border 58 of heat resistant strip 28B. The strip 28B is coupled to the heat resistant strip 28B only along the border 58 of the outer surface 62 of the heat resistant strip 44B.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. An ear cover for covering, protecting, and holding a folded ear on a person's head in a forwardly folded condition while the hair on the person's head is being treated, said cover comprising:

flexible fluid impervious strip shield means for covering and holding the ear in a forwardly folded condition including central non-adhesive ear engaging means, having a length and width sufficient to cover the folded ear when laid thereover, for bearing against the folded ear in said forwardly folded condition; and border strip adhesive means surrounding said central non-adhesive ear engaging means for adhesively sealing to a portion of the person's head surrounding the ear;

said strip shield means including a flexible, water impervious strip having a mid-portion for mounting said central ear engaging portion, said border strip adhesive means being integral with said mid-portion;

said central ear engaging non-adhesive portion comprising a central pad;

said central pad comprising open cell material; said mid-portion including an aperture therethrough aligned with a portion of said strip of open cell material.

2. An ear cover for covering, protecting, and holding a folded ear on a person's head in a forwardly folded condition while the hair on the person's head is being treated, said cover comprising:

flexible fluid impervious strip shield means for covering and holding the ear in a forwardly folded condition including central non-adhesive ear engaging means, having a length and width sufficient to cover the folded ear when laid thereover, for bearing against the folded ear in said forwardly folded condition; and border strip adhesive means surrounding said central non-adhesive ear engaging means for adhesively sealing to a portion of the person's head surrounding the ear;

said central ear engaging means comprising:

an ear engaging padded sheet having an inner face for bearing against the folded ear, and an outer face;

said border strip adhesive means including fluid impervious and heat resistant sheet means having an inner face with a central portion mounting said ear engaging padded sheet, and a perimetrically extending border portion provided with pressure sensitive adhesive means for sealing to the skin of the person's head surrounding the folded ear;

wherein said fluid impervious and heat resistant sheet means further including a laminate comprising a sheet and a heat shield sandwiched between said outer face of said ear engaging padded sheet and said fluid impervious sheet.

3. The ear cover set forth in claim 2 wherein said heat shield and said fluid impervious sheet are generally bell shaped.

4. The ear cover set forth in claim 3 wherein said ear engaging padded sheet is generally rectangular.

5. The ear cover set forth in claim 4 wherein said fluid impervious sheet includes an opening therethrough and said heat shield spans said opening.

6. An ear cover for covering, protecting, and holding a folded ear of a person's head in a forwardly folded condition while the hair on the person's head is being treated, said cover comprising:

an ear engaging sheet of thin flexible non-adhesive material for bearing against the folded ear and including a perimetrical edge; and a mounting sheet of thin flexible material mounted on said ear engaging sheet and having an adhesive border portion coupled to, but projecting outwardly beyond said perimetrical edge for adhesively sealing to a portion of person's head adjacent the folded ear; and a heat resistant sheet of material sandwiched between said ear engaging sheet and said mounting sheet for protecting the folded ear;

said ear engaging sheet having a predetermined width and a predetermined height substantially greater than said predetermined width;

said mounting sheet being fluid impervious;

said mounting sheet having an opening therethrough, said heat resistant sheet spanning said opening and being coupled to said adhesive border portion.

7. An ear cover for covering, protecting, and holding a folded ear of a person's head in a forwardly folded condition while the hair on the person's head is being treated, said cover comprising:

an ear engaging sheet of thin flexible non-adhesive material for bearing against the folded ear and including a perimetrical edge; and a mounting sheet of thin flexible material mounted on said ear engaging sheet and having an adhesive border portion coupled to, but projecting outwardly beyond said perimetrical edge for adhesively sealing to a portion of person's head adjacent the folded ear; and a heat resistant sheet of material sandwiched between said ear engaging sheet and said mounting sheet for protecting the folded ear;

said ear engaging sheet having a predetermined width and a predetermined height substantially greater than said predetermined width;

said mounting sheet being fluid impervious;

said ear engaging sheet including a first predetermined width and a first predetermined height substantially greater than said first predetermined width; said heat resistant sheet having a second predetermined height greater than said first predetermined height, and including an upper portion having a second predetermined width greater than said first predetermined width, and a lower portion having a third predetermined width greater than said second predetermined width.

8. The ear protector set forth in claim 7 wherein said mounting sheet includes an upper portion having a fourth predetermined width greater than said second predetermined width but less than said third predetermined width and a lower portion having a fourth predetermined breadth greater than said third predetermined breadth.

9. An ear cover for covering, protecting, and holding a folded ear of a person's head in a forwardly folded condition while the hair on the person's head is being treated, said cover comprising:

an ear engaging sheet of thin flexible non-adhesive material for bearing against the folded ear and including a perimetrical edge; and a mounting sheet of thin flexible material mounted on said ear engaging sheet and having an adhesive border portion coupled to, but projecting outwardly beyond said perimetrical edge for adhesively sealing to a portion of person's head adjacent the folded ear; and a heat resistant sheet of material sandwiched between said ear engaging sheet and said mounting sheet for protecting the folded ear;

said ear engaging sheet having a predetermined width and a predetermined height substantially greater than said predetermined width;

said mounting sheet being fluid impervious;

said mounting sheet and said heat resistant sheet each having a bell shape;

said mounting sheet having a bell shaped opening therethrough.

10. An ear cover laminate for covering protecting, and holding a folded ear on a person's head in a forwardly folded condition while the hair on the person's head is being treated, said cover comprising:

an ear engaging sheet of open cell material having an inner face for bearing against the folded ear and an outer face; and fluid impervious and heat resistant sheet means having an inner face with a central portion for mounting said ear engaging sheet and a perimetrically extending border portion provided with pressure sensitive adhesive means for sealing in water impervious relation to the skin of the user's head completely around the folded ear;

said sheet means including a laminate comprising a fluid impervious sheet, and a heat resistant sheet of material sandwiched between said outer face of said ear engaging sheet and said fluid impervious sheet;

said ear engaging sheet having a rectangular shape and said heat resistant sheet and said fluid impervious sheet are bell shaped;

said water impervious sheet includes an opening therethrough and said heat resistant sheet is water impervious and spans said opening.

11. An ear cover for covering, protecting, and holding a folded ear on a person's head in a forwardly folded condition while the hair on the person's head is being treated, said cover comprising:

fluid impervious, heat resistant, flexible sheet means having inner and outer faces;

said inner face having a central mounting portion and a perimetrical border portion provided with a layer of pressure sensitive adhesive for sealing to the skin of a person's head surrounding the ear; and an ear engaging flexible sheet of non-adhesive material mounted on said central mounting portion for bearing against the folded ear;

said sheet means comprising a laminate including a water impervious sheet and a heat shield sandwiched between said ear engaging sheet and said fluid impervious sheet;

said heat shield having a predetermined breadth and said fluid impervious sheet having a greater predetermined breadth;

said fluid impervious sheet including an opening therethrough and said heat shield spanning said opening and being sealed to said border portion.

12. A method of covering and protecting the external ear, including a pinna supporting a helix on a person's head, while the hair on the person's head is being treated with fluid comprising the steps of:

forwardly folding the helix of the pinna over on itself;

applying a shield over the folded ear; and adhesively sealing the shield to the portion of the person's head surrounding the ear to preclude any hair treating fluid from reaching the external ear.

13. The method set forth in claim 12 wherein the step of adhesively sealing is accomplished by sealing a portion of the shield to a portion of the person's head rearward of the ear and thereafter sealing a portion of the shield to a portion of the person's head forward of the ear.

* * * * *